US006890200B1

(12) United States Patent
Wu

(10) Patent No.: US 6,890,200 B1
(45) Date of Patent: May 10, 2005

(54) FLOATABLE PANEL MOUNT CABLE ASSEMBLY

(75) Inventor: Jerry Wu, Irvine, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/729,345

(22) Filed: Dec. 4, 2003

(51) Int. Cl.[7] ..... H01R 13/74
(52) U.S. Cl. ..... 439/247; 439/64; 439/573
(58) Field of Search ..... 439/247–248, 439/573, 64

(56) References Cited

U.S. PATENT DOCUMENTS 5,228,865 A * 7/1993 Douty et al. ..... 439/247
6,030,242 A * 2/2000 Cunningham et al. ..... 439/247
6,033,247 A * 3/2000 Gregory, II ..... 439/248

* cited by examiner

*Primary Examiner*—Truc Nguyen
(74) *Attorney, Agent, or Firm*—Wei Te Chung

(57) ABSTRACT

A cable assembly (7) includes an insulative housing (1) and a number of contacts (2) received in the insulative housing. The cable assembly includes a base (10) along a longitudinal direction thereof, a mating portion (11) extending forwardly from a front face (101) of the base along a mating direction perpendicular to the longitudinal direction, and a pair of mounting ears (15) integrally formed at opposite ends of the base. A bulge (14) and at least one projection (13) are formed on the housing adjacent the front face of the base for engaging with a first face and an opposite second face of a panel, respectively.

9 Claims, 9 Drawing Sheets

FLOATABLE PANEL MOUNT CABLE ASSEMBLY

CROSS-REFERENCE TO RELATED APPLICATIONS

Relevant subject matter is disclosed in U.S. patent application Ser. Nos. 10/658,563 filed on Sep. 8, 2003 and entitled "ELECTRICAL CONNECTOR ASSEMBLY WITH BLIND MATE STRUCTURE", 10/665,843 filed on Sep. 18, 2003 and entitled "SPACE-SAVING CABLE CONNECTOR ASSEMBLY WITH BLIND MATE STRUCTURE" and 10/671,117 filed on Sep. 24, 2003 and entitled "CABLE CONNECTOR ASSEMBLY", all of which are invented by the same inventor and assigned to the same assignee as this application.

BACKGROUND OF THE INVENTION

1. Field of the Invention

The present invention relates to a cable assembly, and particularly to a floatable panel mount cable assembly.

2. Description of Related Art

Cable assemblies are widely used in electronic devices for signal or power transmission. Such a cable assembly is usually needed to be float-mounted to a panel on which plural connectors are arranged side by side to form a sub module. U.S. Pat. Nos. 4,647,130 and 4,615,641 each disclose such an assembly.

The assembly disclosed in U.S. Pat. No. 4,647,130 comprises matable plug and receptacle connectors. The plug connector comprises a pair of flanges diagonally formed at opposite ends of a base thereof and a pair of guide pins disposed at opposite ends of the base and diagonally across from each other. Each flange defines a mounting hole therein and a pair of arcuate projections are located at a substantial angle from the major axis of the plug connector and are around corresponding mounting holes. A pair of elastomeric ring-like members are secured around a corresponding pair of projections. A pair of shoulder screws respectively protrude through the mounting holes and the elastomeric ring-like members to tightly engage with a panel. However, this design is complicated and increases the manufacturing cost.

U.S. Pat. No. 4,915,641 discloses a pair of matable female and male connectors each being mounted to a corresponding pair of panels, respectively. The male connector comprises a pair of flanges on opposite ends thereof and each flange defines a mounting aperture and a mounting collar therethrough to enable the float mounting of the male connector to a corresponding panel. The collar is a generally cylindrical collar having an aperture dimensioned to receive a bolt, rivet or other connecting means. However, the flanges of the male connector occupy a relatively large space and the dimension of the male connector in a longitudinal direction thereof is thus increased. Further, when the female connector engages with or disengages from the male connector, the male connector is easy to rotate with respect to the panel, which results in the difficulty of ensuring a reliable electrical connection between the male connector and the female connector.

Hence, an improved floatable cable assembly is highly desired to overcome the disadvantages of the prior art.

SUMMARY OF THE INVENTION

Accordingly, an object of the present invention is to provide a floatable panel mount cable assembly which can be prevented from rotating with respect to a panel when the cable assembly engages with or disengages from a complementary connector.

Another object of the present invention is to provide a panel mount cable assembly with a simplified structure and a minimized lengthwise dimension.

In order to achieve the objects set forth, a cable assembly adapter for being mounted in a mounting opening of a panel in accordance with the present invention comprises an insulative housing and a plurality of contacts received in the insulative housing. The housing includes a base along a longitudinal direction thereof, a mating portion extending forwardly from a front face of the base along a mating direction perpendicular to the longitudinal direction, a pair of mounting ears integrally formed at opposite ends of the base and a pair of guiding members forwardly extending from the base by two sides of the mating portion, respectively. A bulge is formed on the base adjacent a front face of the base. A pair of projections respectively extend downwardly from the guiding members. The bugle and the pair of projections are respectively adapted for engaging with a first and a second opposite faces of the panel.

Other objects, advantages and novel features of the invention will become more apparent from the following detailed description when taken in conjunction with the accompanying drawings.

DETAILED DESCRIPTION OF THE PREFERRED EMBODIMENT

Figure 1:
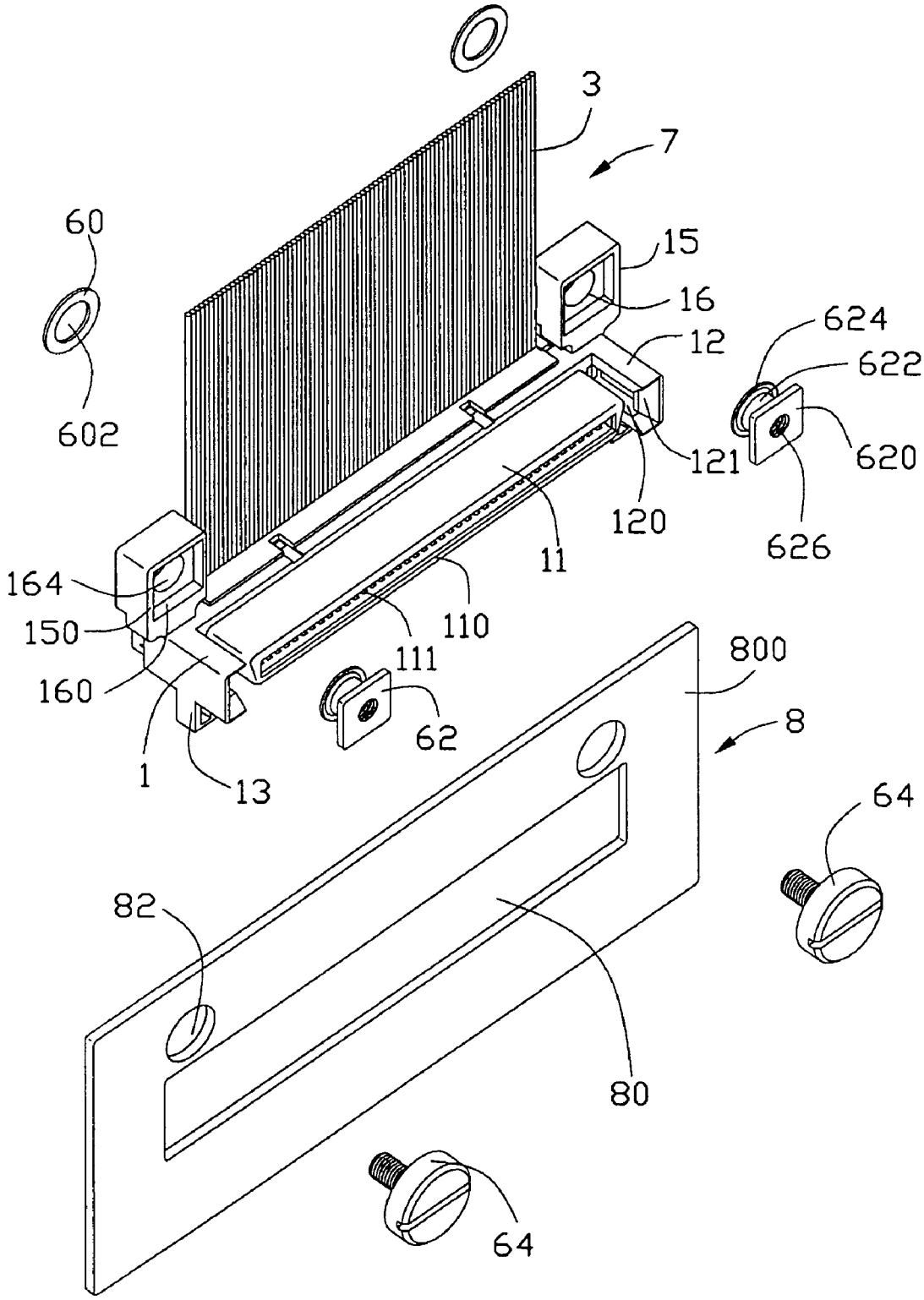
FIG. 1 is a perspective view of a cable assembly in accordance with the present invention and a panel to which the cable assembly is mounted.

Reference will now be made in detail to the preferred embodiment of the present invention.

Referring to FIGS. 1–3 and 7–9, a cable assembly 7 in accordance with the present invention, which is float-mounted on a panel 8 via a pair of fastening devices 6, comprises an insulative housing 1, a plurality of IDC (Insulation Displacement Contact) terminals 2 received in the insulative housing 1, a multi-conductor flat cable 3 electrically connecting with the terminals 2, a spacer 4 assembled to the insulative housing 1 for positioning insulation displacement sections of the terminals 2 and a termination cover 5 for being latchably mounted on the insulative housing 1. In a preferred embodiment, the cable assembly 7 is a SCA (Single Connector Attachment) cable assembly.

The insulative housing 1 is substantially elongated and comprises a base 10 and a mating portion 11 extending perpendicularly and forwardly from a front face 101 of the base 10. The insulative housing 1 has a front mating face 110 facing a complementary connector (not shown) and a terminating face 102 (FIG. 2) opposite to the mating face 110. The insulative housing 1 also defines a mating direction and a longitudinal direction perpendicular to the mating direction.

A pair of guiding members 12 protrude forwardly from the base 10 at opposite ends of the mating portion 11 and beyond the mating face 110 of the insulative housing 1 for guiding the cable assembly 7 to correctly mate with a complementary connector (not shown). Each guiding member 12 defines a U-shaped receiving cavity 120 and is chamfered to form a lead-in 121 at a front end thereof. A pair of protrusions 13 extend downwardly from the guiding members 12 adjacent to the front face 101 of the base 10. A bulge 14 is formed on a lower face of the base 10. The distance between each protrusion 13 and the bulge 14 along the mating direction is slightly larger than a thickness of the panel 8. A pair of mounting ears 15 extend upwardly from an upper face of the base 10 and each is generally aligned with a corresponding one of the guiding members 12 along a transverse direction perpendicular to both the mating direction and the longitudinal direction of the insulative housing 1. Each mounting ear 15 defines a mounting hole 16 therethrough along the mating direction. The mounting hole 16 includes a front rectangular recess 160 in a front face 150 of the mounting ear 15, a rear circular recess 162 in a rear face 152 of the mounting ear 15, and a round hole 164 interconnecting the front rectangular recess 160 with the rear circular recess 162. The bulge 14 and the pair of projections 13 are located at opposite sides of the front face 150 of the mounting ear 15.

The insulative housing 1 defines a receiving space 111 in the mating face 110, a cavity 104 in the terminating face 102 and a plurality of passageways 112 in opposite longitudinal inner faces of the mating portion 11 and communicating with the cavity 104 and the receiving space 111. The base 10 defines a pair of channels 106 (FIG. 9) at opposite ends thereof and respectively communicating with the receiving cavities 120 of the guiding members 12. The base 10 is formed with a pair of mounting wedges 114 extending beyond the terminating face 102 and adjacent the channels 106.

Figure 7:
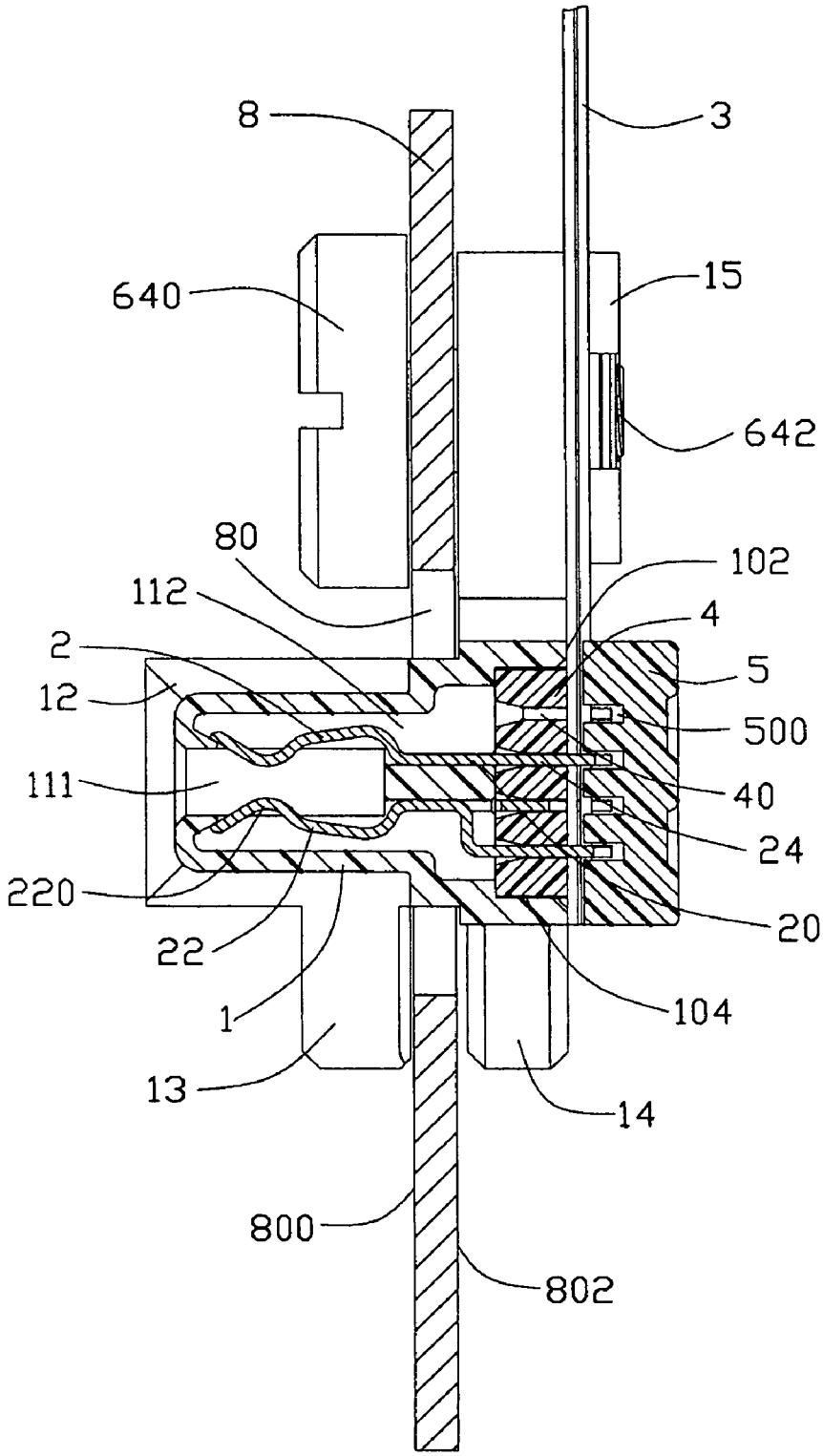
FIG. 7 is a cross-section view taken along line 7—7 of FIG. 6.
Figure 9:
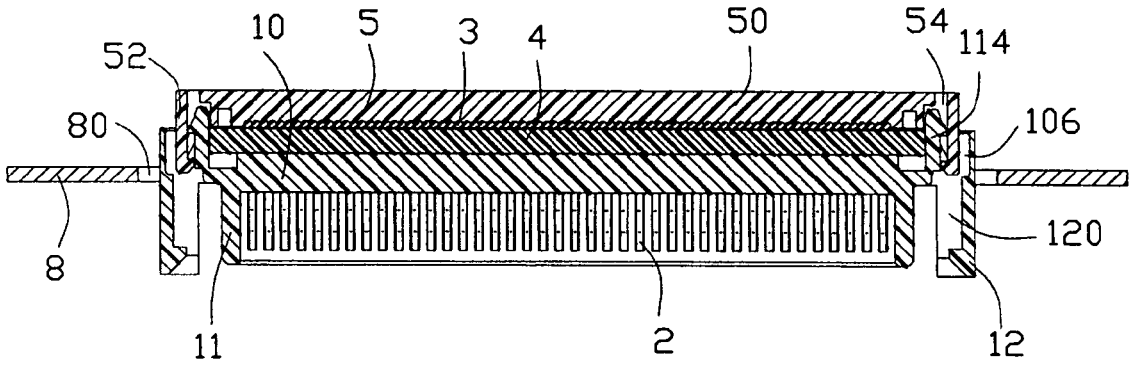
FIG. 9 is a cross-section view taken along line 9—9 of FIG. 6.

Referring to FIGS. 7 and 9, the terminals 2 are received in the passageways 112 of the insulative housing 1. Each terminal 2 comprises a retention section 20 secured in a corresponding passageway 112, a mating section 22 extending from one end of the retention section 20 with a curved mating end 220 exposed into the receiving space 111, and an insulation displacement section 24 extending from the other end of the retention section 20.

The spacer 4 is elongated and is made of insulative material. The spacer 4 is received in the cavity 104 of the insulative housing 1 and defines a plurality of slots 40 with the insulation displacement sections 24 of the terminals 2 extending thererough for positioning purpose.

The termination cover 5 is assembled to a rear of the insulative housing 1 to perform electrical connections between the cable 3 and the insulation displacement sections 24 of the terminals 2. The termination cover 5 includes a main body 50, a pair of forwardly extending mounting lugs 52 at opposite ends thereof, and a pair of through holes 54 adjacent the mounting lugs 52. The main body 50 defines a plurality of grooves 500 in a front face thereof for receiving the insulation displacement sections 24 of the terminals 2. The pair of mounting lugs 52 of the termination cover 5 and the pair of mounting wedges 114 of the insulative housing 1 are respectively received in the channels 106 of the insulative housing 1 and the through holes 54 of the cover 5 to thereby latch with each other. Thus, the cover 5 is securely assembled to the insulative housing 1.

Figure 2:
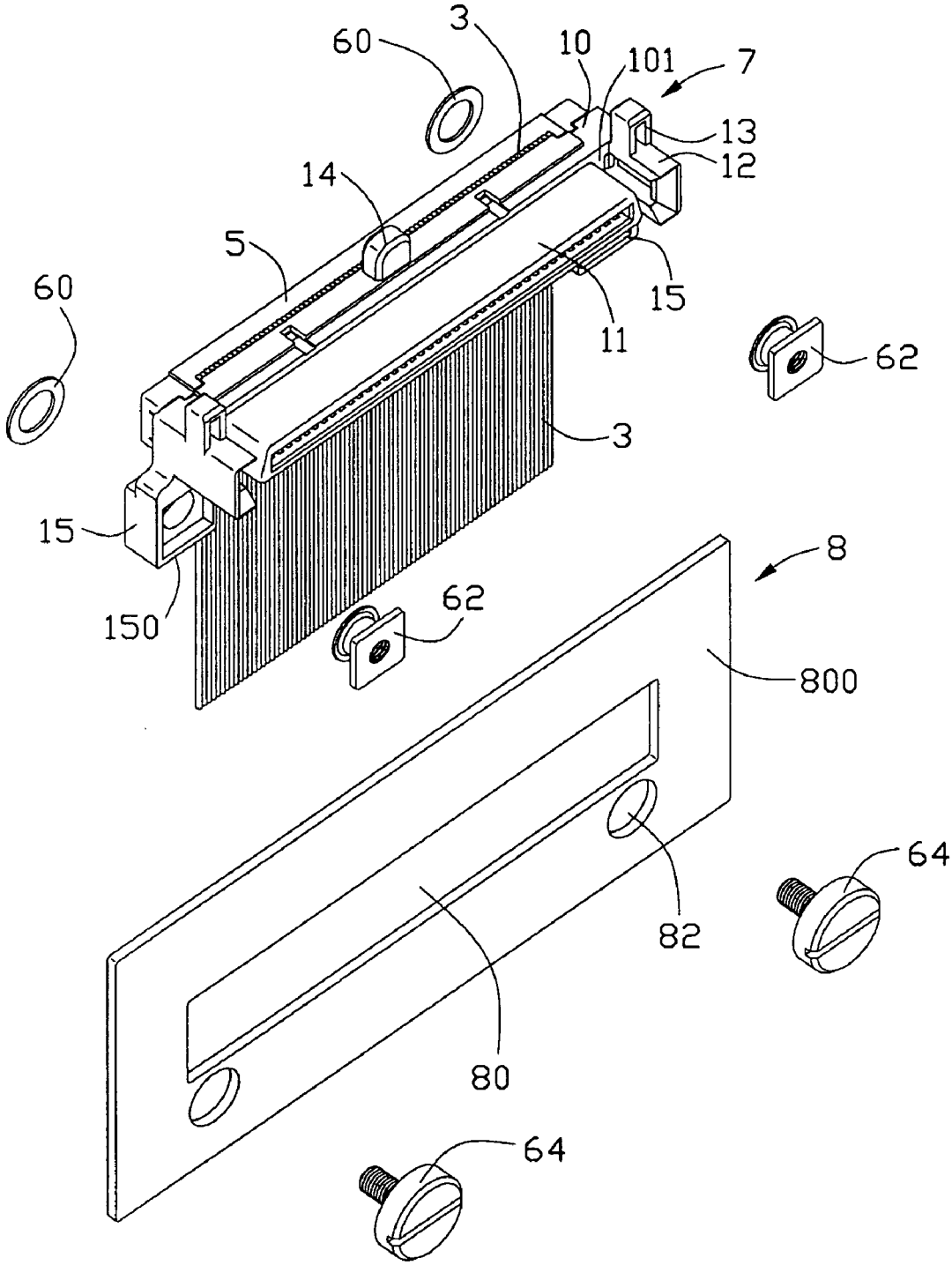
FIGS. 2 and 3 are views similar to FIG. 1, but taken from different aspects.
Figure 3:
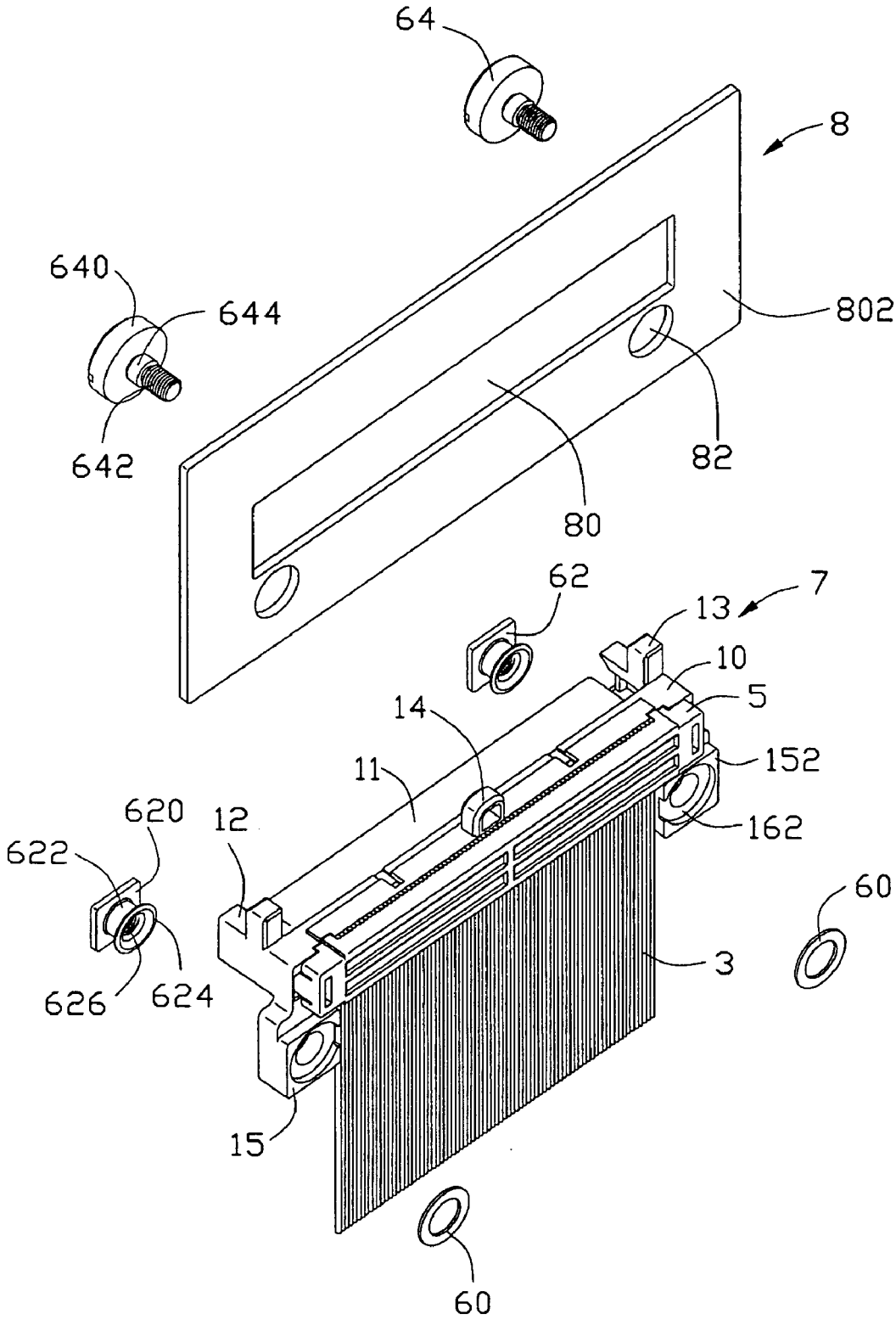
Figure 8:
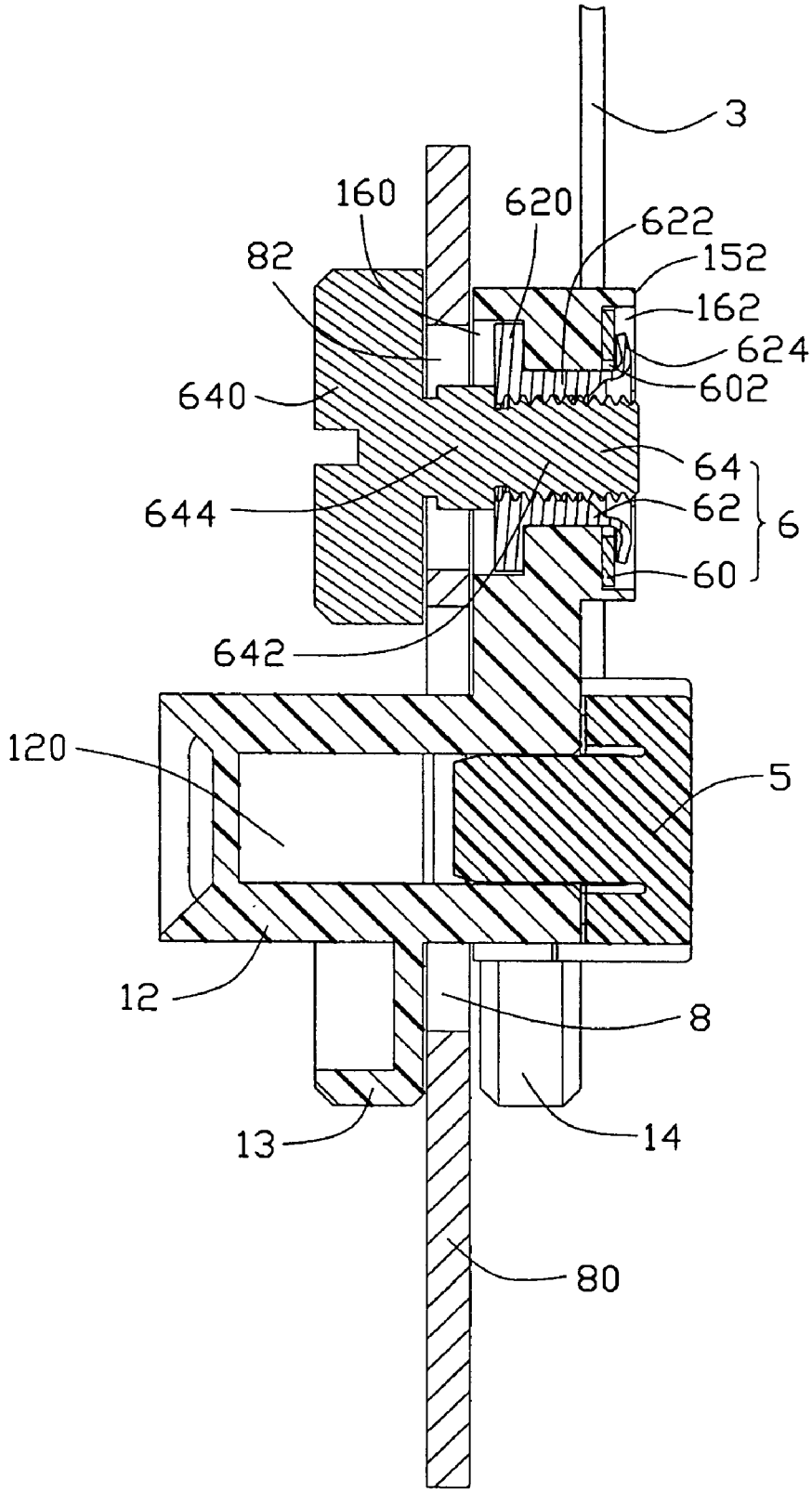
FIG. 8 is a cross-section view taken along line 8—8 of FIG. 6.

Referring to FIGS. 1–3 in conjunction with FIG. 8, each fastening device 6 comprises a washer 60, a hardware rivet 62 and a bolt 64. The washer 60 is assembled into the rear circular recess 162 from the rear face 152 of the mounting ear 15. The hardware rivet 62 is assembled into the mounting hole 16 from the front face 150 of the mounting ear 15 and includes a rectangular plate 620 received in the front rectangular recess 160, a cylindrical post 622 extending from the plate 620 and received in the round hole 164, and an annular end 624 located at a free end of the cylindrical post 622 and extending into the rear circular recess 162 through a through hole 602 of the washer 60. The rectangular plate 620 rearwardly abuts against an inner face of the front rectangular recess 160 and the annular end 624 forwardly abuts against the washer 60 to thereby retaining the washer 60 and the hardware rivet 62 in the mounting ear 15. The rivet 62 defines a screw hole 626 therein. The bolt 64 includes an enlarged head 640, a threaded portion 642 and a medial portion 644 interconnecting the enlarged head 640 and the threaded portion 642.

The panel 8 is a rectangular board and defines a mounting opening 80 in a center thereof and a pair of mounting apertures 82 located above the mounting opening 80 corresponding to the mounting holes 16 in the mounting ears 15.

Figure 4:
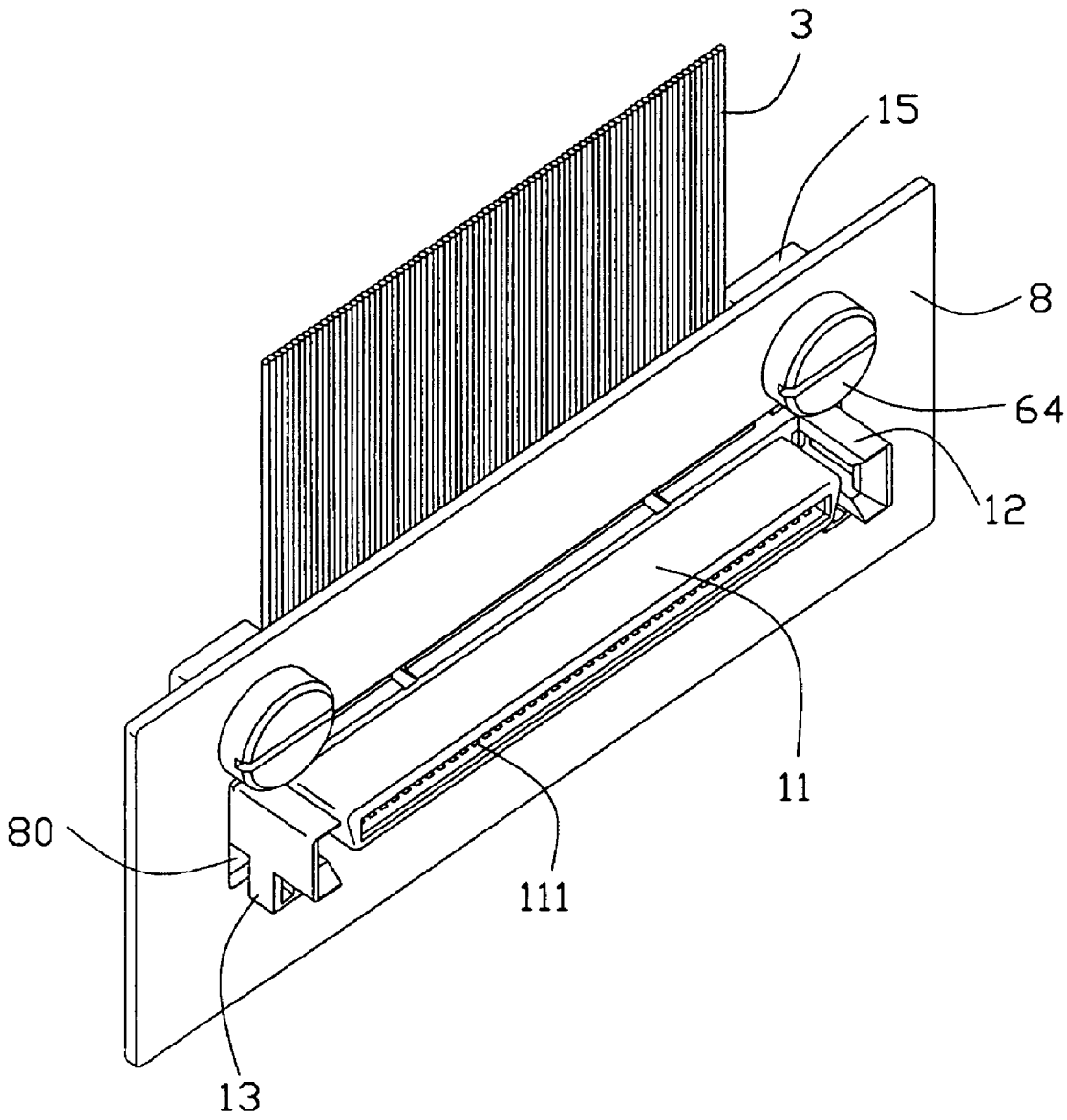
FIG. 4 is a perspective view showing the cable assembly mounted on the panel to form a system.
Figure 5:
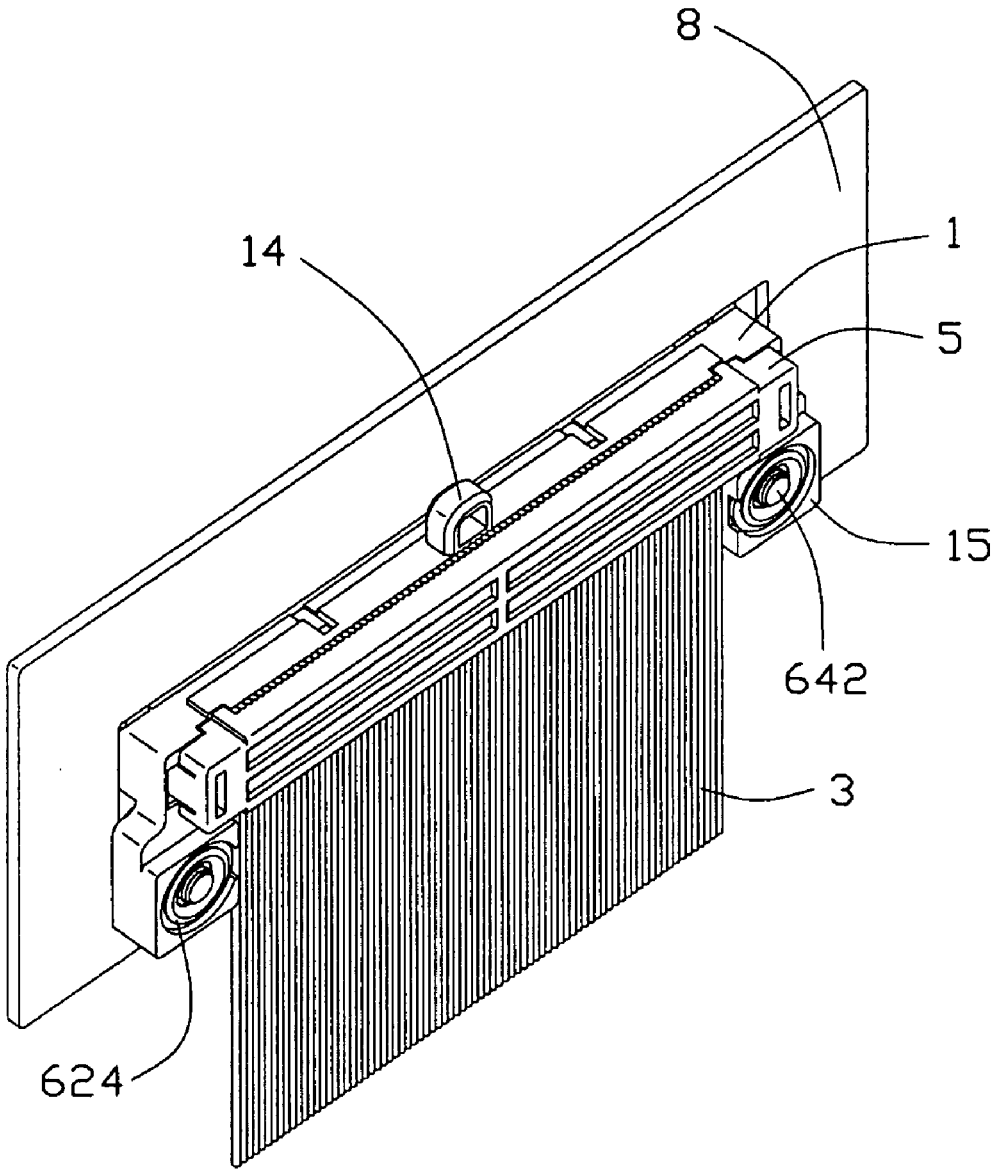
FIG. 5 is a view similar to FIG. 4 but taken from a different aspect.
Figure 6:
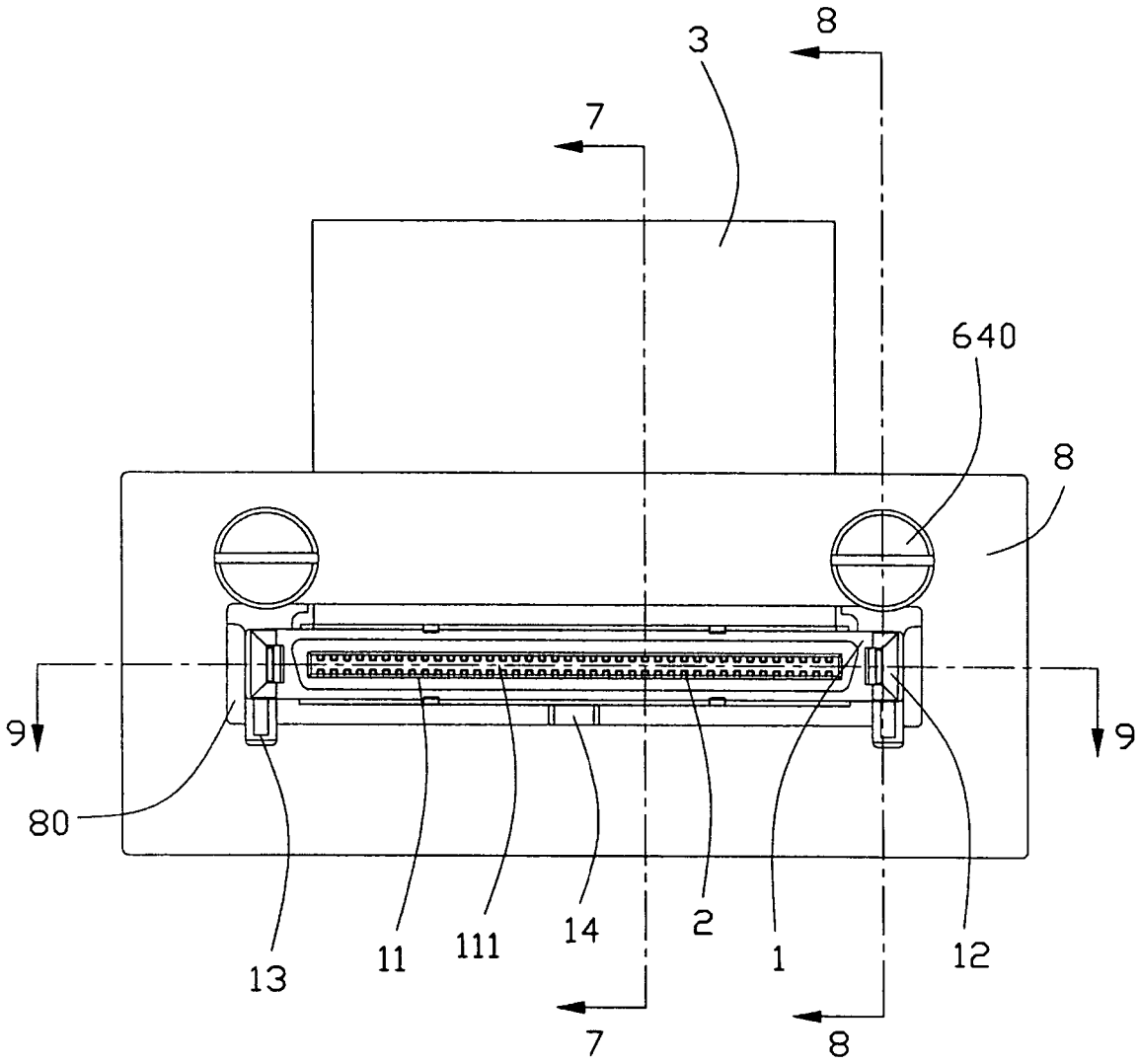
FIG. 6 is a front planar view of the system shown in FIG. 4.

Referring to FIGS. 4–6 in conjunction with FIGS. 7–9, when the cable assembly 7 is assembled to the panel 8, the mating portion 11 and the pair of guiding members 12 extend through the mounting opening 80 until the front faces 150 of the mounting ears 15 abut against a rear face 802 of the panel 8. The pair of projections 13 and the bulge 14 respectively abut against a front face 800 and the rear face 802 of the panel 8. The bolt 64 extends into the screw hole 626 through the mounting hole 82 of the panel 8 with the threaded portion 642 engaging with the screw hole 626 and with the medial portion 644 and the enlarged head 640 respectively abutting against the rectangular plate 620 of the rivet 62 and the panel 8. The diameter of the medial portion 644 is larger than the diameter of the screw hole 626 of the rivet 62 while is smaller than the diameter of the mounting aperture 82 of the panel 8. Therefore, the cable assembly 7 is floatablely mounted on the panel 8.

When the complementary connector engages with or disengages from the cable assembly 7, the cable assembly 7 tends to rotate about the fastening devices 6. Since the protrusions 13 and the bulge 14 respectively abut against the front face 800 and the rear face 802 of the panel 8, respectively, the cable assembly 7 is thus prevented from rotating when engaging with or disengaging from the complementary connector.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A cable assembly adapted for being mounted to a panel, comprising:

an insulative housing defining a mating direction and a longitudinal direction perpendicular to the mating direction and comprising a base and a mating portion extending forwardly from a front face of the base along the mating direction, a pair of mounting ears integrally formed at opposite ends of the base, the insulative housing comprising a bulge and at least one projection respectively located adjacent the front face of the base adapted for engaging with a first face and an opposite second face of the panel, respectively; and a plurality of contacts received in the insulative housing;

wherein the housing comprises a pair of guiding members forwardly extending from the base by two sides of the mating portion, respectively;

wherein each mounting ear generally aligned with a extends upwardly from an upper face of the base and is corresponding one of the guiding members in a transverse direction perpendicular to both the longitudinal direction and the mating direction;

wherein the at least one projection comprises a pair of projections respectively extending downwardly from the guiding members;

wherein the bulge extends downwardly from the base and is located at a center of the base along the longitudinal direction.

2. The cable assembly as claimed in claim 1, further comprising a cable electrically connecting with the contacts.

3. The cable assembly as claimed in claim 2, further comprising a spacer defining a plurality of slots, and wherein the insulative housing has a mating face and a terminating face opposite to the mating face and defines a cavity extending from the terminating face toward the mating face to receive the spacer, the contacts comprising insulation displacement sections respectively protruding through the slots of the spacer.

4. The cable assembly as claimed in claim 3, further comprising a cover assembled to a rear of the insulative housing, the cover defining a plurality of grooves receiving the insulation displacement sections of the contacts.

5. An electrical system comprising:

a panel defining a first face, a second face opposite to the first face, a mounting opening extending through the first and the second faces and a pair of mounting apertures located above the opening;

a cable assembly comprising:

an insulative housing comprising a base along a longitudinal direction, a mating portion extending forwardly from the base along a mating direction perpendicular to the longitudinal direction and protruding through the mounting opening of the panel, and a pair of mounting ears located at opposite ends thereof and in alignment with the corresponding mounting apertures, the insulative housing comprising a bulge and a projection respectively engaging with the first and the second faces of the panel adjacent the mounting opening to counterbalance external force exerted on the cable assembly in the mating direction;

a plurality of contacts disposed in the insulative housing; and a pair of fastening devices rearwardly extending through the mounting apertures of the panel and the mounting ears of the housing to mount the cable assembly on the panel wherein the housing comprises a pair of guiding members forwardly extending from the base by two sides of the mating portion respectively;

wherein each mounting ear generally aligned with a extends upwardly from an upper face of the base and is corresponding one of the guiding members in a transverse direction perpendicular to both the longitudinal direction and the mating direction;

wherein the at least one projection comprises a pair of projections respectively extending downwardly from the guiding members;

wherein the bulge extends downwardly from the base and is located at a center of the base along the longitudinal direction.

6. The system as claimed in claim 5, wherein each mounting aperture comprises a front recess, a rear recess and a round hole located between the front and the rear recesses.

7. The system as claimed in claim 6, wherein each fastening device comprises a washer received in the rear recess of a corresponding mounting aperture, a rivet defining a screw hole and a bolt, the rivet including a plate received in the front recess, a cylindrical post received in the round hole and an annular portion extending through the washer to be received in the rear recess, the bolt extending into the screw hole of the rivet through the mounting aperture of the panel and including a screw post engaging with the screw hole and a head abutting against the panel.

8. The system as claimed in claim 7, wherein the bolt includes a medial portion located between the head and the screw post, the medial portion having a diameter larger that a diameter of the screw hole of the rivet but smaller than a diameter of the mounting aperture.

9. The system as claimed in claim 8, wherein the medial portion of the bolt abuts against the plate of the rivet.

* * * * *